US006413371B1

(12) United States Patent
Ahonen et al.

(10) Patent No.: US 6,413,371 B1
(45) Date of Patent: Jul. 2, 2002

(54) METHOD FOR MANUFACTURE OF PAPER AND A PAPER MACHINE

(75) Inventors: Pasi Ahonen; Juha S. Kinnunen; Mari Taipale; Pirkko-Leena Aarnikoivu, all of Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/719,346

(22) PCT Filed: May 28, 1999

(86) PCT No.: PCT/FI99/00466

§ 371 (c)(1),
(2), (4) Date: Dec. 8, 2000

(87) PCT Pub. No.: WO99/64672

PCT Pub. Date: Dec. 16, 1999

(30) Foreign Application Priority Data

Jun. 10, 1998 (FI) ..... 981331

(51) Int. Cl.[7] ..... D21F 9/02

(52) U.S. Cl. ..... 162/136; 162/205; 162/125; 162/265

(58) Field of Search ..... 162/123–133, 162/135–137, 203, 205, 206, 272, 289, 358.1, 358.2, 358.3, 358.4, 358.5, 360.2, 360.3, 361, 381, 265; 427/361; 118/65, 67, 68

(56) References Cited

U.S. PATENT DOCUMENTS 3,607,486 A * 9/1971 Jacks et al. ..... 156/41
4,075,056 A 2/1978 Ely et al. ..... 162/305

(List continued on next page.)

FOREIGN PATENT DOCUMENTS

EP 0651092 5/1992 ..... D21F/9/00

(List continued on next page.)

OTHER PUBLICATIONS

U.S. Serial No. 08/467,780—Method for Producing Surface–Treated Paper and Dry End of a Paper Machine (pp. 1–50).
U.S. Serial No. 09/319,972—Calender Provided with an Extended Nip ((pp. 1–12.

*Primary Examiner*—Peter Chin
*Assistant Examiner*—Eric Hug
(74) *Attorney, Agent, or Firm*—Steinberg & Raskin, P.C.

(57) ABSTRACT

The invention concerns a method for manufacture of paper, most appropriately for porous paper for color powder printing. In the method paper is manufactured by means of a paper machine. In the method the paper stock is fed out of the headbox (100) into the wire part (200), in which wire part (200) water is drained out of the paper web in both directions. In the method the paper web (W) is passed from the wire part (200) into the press section (300) in order to press water out of the paper web (W), and after the press section (300), the paper web (W) is dried in the dryer section (400) and coated/pigmented in the coating section (500), dried in an after-dryer section (600) and calendered in a calender (600), and reeled in a reel-up (800). The paper web (W) is made of layers in the Z-direction so that the desired distributions of additives and fillers are obtained in the different layers in the Z-direction of the paper web (W), and the paper web (W) is calendered in at least one calendering nip, which maintains or at least substantially retains the porosity of the web preceding the calendering. The invention also concerns a paper machine, most appropriately for manufacture of glossy and porous paper for color powder based printing. The paper machine comprises a headbox (100), a wire part (200), a press section (300), a dryer section (400), a coating section (500), an after-dryer section (600), a calender (700), and a reel-up (800). The headbox (100) and the wire part (200) have been formed so that the desired layers with different compositions in the Z-direction are provided in the paper, and the calender (700) is a calender device that maintains or at least substantially retains the porosity of the paper web (W) preceding the calendering.

22 Claims, 9 Drawing Sheets

U.S. PATENT DOCUMENTS

| | | | | | |
|---|---|---|---|---|---|
| 4,477,313 | A | * | 10/1984 | Andersson | 162/123 |
| 4,510,019 | A | * | 4/1985 | Bartelloni | 162/141 |
| 4,666,516 | A | | 5/1987 | Hornung et al. | 420/30 |
| 4,687,548 | A | | 8/1987 | Ilmoniemi et al. | 162/216 |
| 5,074,964 | A | | 12/1991 | Partanen | 162/203 |
| 5,246,497 | A | | 9/1993 | Rantanen | 118/249 |
| 5,609,726 | A | * | 3/1997 | Sollinger | 162/125 |
| 5,650,010 | A | | 7/1997 | Rantanen et al. | 118/224 |
| 5,770,013 | A | * | 6/1998 | Chance et al. | 162/127 |
| 5,858,076 | A | * | 1/1999 | Thompson | 106/217.3 |
| 5,916,419 | A | * | 6/1999 | Nicholson et al. | 162/136 |
| 6,022,448 | A | * | 2/2000 | Eriksson et al. | 162/123 |
| 6,027,615 | A | * | 2/2000 | Davenport et al. | 162/358.2 |

FOREIGN PATENT DOCUMENTS

| | | | |
|---|---|---|---|
| EP | 0726353 | 8/1996 | D21F/5/04 |
| EP | 0770727 | 5/1997 | D21F/3/04 |
| EP | 0780237 | 6/1997 | B41M/1/36 |
| FI | 83540 | 4/1991 | C21C/1/08 |
| FI | 924960 | 7/1995 | D21H/23/58 |

* cited by examiner

METHOD FOR MANUFACTURE OF PAPER AND A PAPER MACHINE

FIELD OF THE INVENTION

The present invention relates to a paper machine including a headbox, a wire part in which water is drained from a paper web, a press section arranged afer the wire section in the running direction of the paper machine for pressing water out of the web, a dryer section arranged after the press section, a coating section arranged after the dryer section, an after dryer arranged after the coating section, a calender section arranged after the after dryer and a reel up arranged after the calender section. The present invention also relates to a method of making paper in a paper machine of the type described above.

BACKGROUND OF THE INVENTION

Paper grades manufactured by means of prior-art methods and paper machines do not meet all present-day or future needs in respect of paper grades. One important need is glossy porous paper, which is well suited for colour-powder based printing. This need arises, among other things, from the fact that, along with increasing speeds and improved printing quality of colour copiers, in colour-powder based printing, colour copiers have started competing with sheet-offset printing and, on the other hand, this need also arises from the fact that, in black/white printing, digital processing of image and laser technology have improved the quality of the picture to the level of offset printing. One problem in printing with a colour copier is inadequate gloss of the paper to be used. Coated paper is not directly suitable for use in sheet-feed colour copiers, but one of the problems is a so-called glass-sheet effect between two sheets, i.e. the sheets tend to adhere to each other. In friction-based feeders in colour copiers, coated papers do not operate at all, and also in vacuumbased feeders they operate poorly. Thus, in colour-powder printing, such a coated or compacted paper is needed as does not adhere to the colour powder fixing unit and in whose use said problem of glass-sheet effect does not occur. It has also been a problem that humidity may remain in the interior of compacted paper when the paper is dried from both sides.

Thus, in actual fact, there is no method or paper machine suited for the manufacture of papers of this type, and of the paper grades currently available, usually a supercalendered fine paper is used, but it is a problem of this paper grade that it is not sufficiently glossy.

As is known from the prior art, said paper grades are manufactured in paper machines in which the headbox is, for example, a hydraulic headbox, for example SymFlo™ or some other conventional headbox of the same type. The wire part that is used is a fourdrinier wire or a hybrid wire part, for example SymFormer™, in which there are a fourdrinier wire and an upper-wire unit. Also, gap formers have been used in the manufacture of paper grades of different types. From the prior art, a method is also known for application of additives, fillers and chemicals as layers. This method is described in the patent EP 0 651 092. As a press section, presses of many types are used, usually roll presses. From the prior art, different extended-nip press solutions are also known, which have, however, not been applied to the manufacture of papers used for colour-powder based printing. The dryer sections have been made of conventional dryer sections which make use of single-wire or twin-wire draw and in which the drying takes place primarily as cylinder drying. Impingement drying is known from a number of different patent publications, but industrial applications are not in operation as yet. On the contrary, some use has been made of air drying arranged by means of the principle of infra drying or airborne-web drying. As size presses, size presses of many different types are used, for example tub size presses or solutions of the type of the applicant's SymSizer. The calender has, as a rule, been a soft calender with one or two nips and combinations formed out of them. Also, supercalendering has been used for the manufacture of the final product. The reel-up has been a suitable reel-up. Paper machines of the types described above and component units of said machines have been described, for example, in the following published patent applications and patents: FI 75,377, FI 83,540, FI 98,540, U.S. Pat. No. 4,075,056, EP 0 770 727, FI 98,387, FI 901967, and FI 924960. By means of these machines, a paper grade well suited for colour-powder based printing has, however, not been achieved, owing to the above problems.

The prior art does not know a suitable paper machine or an applicable method for manufacture of paper that has, first, copying paper properties and good gloss and suitable porosity for colour-powder printing. Further, among traditional properties of copying paper, important properties are, among other things, properties of electric charge and resistivity and dimensional stability. It is, however, expected that the need of paper grades of this type will increase in the near future, so that a method and a paper machine are needed for manufacture of such papers.

OBJECTS AND SUMMARY OF THE INVENTION

Thus, the object of the present invention is to provide a method and a paper machine by whose means it is possible to manufacture especially a paper of this type with suitable gloss and suitable porosity.

In accordance with the invention, the paper web is formed as layers in the Z-direction so that the desired distributions of additives and fillers are obtained in the different layers in the Z-direction in the web. The web is calendered in at least one calendering nip, which maintains or at least substantially retains the porosity of the web preceding the calendering. Favourably, the web is calendered in a shoe calender which comprises an extended calendering nip. Successive calendering operations can be carried out in the same calendering device or in separate successive devices.

In accordance with the invention, the headbox and the wire part of the paper machine have been formed so that the desired composition of layers is obtained for the paper in the Z-direction. The calender is a calender device that maintains or at least substantially retains the porosity of the web preceding the calendering, for example a device provided with an extended calendering nip or a device provided with an extensible calendering nip and controlled in compliance with the load, favourably a shoe calender.

The porosity of the paper that is aimed at and most appropriately manufactured by means of the method and the paper machine in accordance with the invention is higher than 150 Bendtsen units, measured in compliance with the Scan-P 60:87 standard, and the gloss is higher than 25 Hunter gloss units, measured in compliance with the Tappi 4/80 M-90 method. Characteristics of prior-art papers less well suited for multi-colour printing are, among other things:

basis weight: 80 . . . 200 g/m$^2$ (grams per sq.meter), typically about 100 g/m$^2$, porosity: 150 . . . 1200 Bendtsen, typically 150 . . . 350 Bendtsen, roughness: about 30 . . . 100 Bendtsen, typically about 50 Bendtsen, thickness: 50 . . . 200 microns, typically about 100 microns, gloss: 10 . . . 20 Hunter 75°, non-coated, because coated papers are too dense, or slightly (2 . . . 6 grams per sq.m per side) pigmented.

Thus, at present, no method is known for manufacture of a paper that is provided with the combination of porosity/gloss provided by the present invention.

In connection with the present invention, all conventional raw-materials of fine paper are suitable for use, both with short fibres and with long fibres, obtained from all wood species. As fillers, for example, carbonate and talc are used. Thus, the invention is carried into effect with existing paper raw-materials known in themselves.

When a paper in accordance with the invention is manufactured, in a way in itself known the additives, retention agents and fillers in the paper are applied as layers in the desired way from a multi-layer headbox to the wire part, by means of which procedure attempts are made to provide a chemical formation of layers in the Z-direction. When suitable additives and fillers are used, there is almost no need to act upon the distributions within the layers. Porosity of the paper can be produced in the wire part also by means of retention by using a retention agent and vacuums, whose use promotes the formation of porosity. However, it is also important that good formation is achieved. The former must be such that it does not damage the layer formation that has been produced. For example, a gap former is suitable for this purpose, but formers of other types are also suitable for use, at least to a limited extent. In view of improving the gloss, the desired distribution of fillers is substantially U-shaped. This form of distribution of fillers is obtained by means of said formation of layers in the paper. Thus, in this way, a better gloss is obtained after calendering.

In the press section, an extended-nip press is used, for example a shoe press. An extended nip is particularly well suited for this purpose, because in it the paper is compacted uniformly while the porosity is retained. Thus, in the Z-direction, a uniform distribution of density is obtained. If, for example, a roll press were used, the surface of the paper would be compacted to a higher extent than the middle.

In drying, favourably impingement drying is employed, which maintains the porosity of the paper, but traditional cylinder drying is also suitable for use.

In surface sizing and pigmenting, the film transfer method is used, in which case the paper remains more porous. In such a case, a uniform layer of coating agent is obtained, and the electric charge on the X/Y axis is even. If necessary, the web can also be pre-calendered before the film coating.

As the calender, a calender is used that substantially retains the porosity of the web preceding the calendering, preferably a shoe calender, in which case the porosity of the paper is retained and the gloss and the smoothness can be brought to the desired levels. As an extended-nip calender, it is also possible to use a so-called belt calender. With respect to a shoe calender and to a belt calender, reference is made to the applicant's Patent Application FI 973954 and to the prior art referred to in said patent application. Also, for example, OptiLoad™ calenders and soft calenders are suitable for the arrangement in accordance with the invention, but their use is not equally advantageous as the use of a shoe calender.

If necessary, it is possible to use pre-calendering before coating, in a way in itself known, in order to provide a low extent of pigmenting.

An important part in a paper machine in accordance with the invention is the headbox and the wire part, by whose means the formation of layers is produced, and a second important unit is the calender, by whose means the retaining of the porosity that has been achieved and the desired gloss are secured. The porosity and the gloss and the other properties of the paper grade to be produced are, of course, also affected by means of the surface sizing unit, the press section, and by means of the drying method. It has, however, been noticed that the formation of layers in the web and calendering of a correct type are the essential factors.

BRIEF DESCRIPTION OF THE DRAWINGS

In the following, the invention will be described in more detail with reference to the figures in the accompanying drawing, the invention being, however, not supposed to be strictly confined to the details of said illustrations alone.

Figure 1:
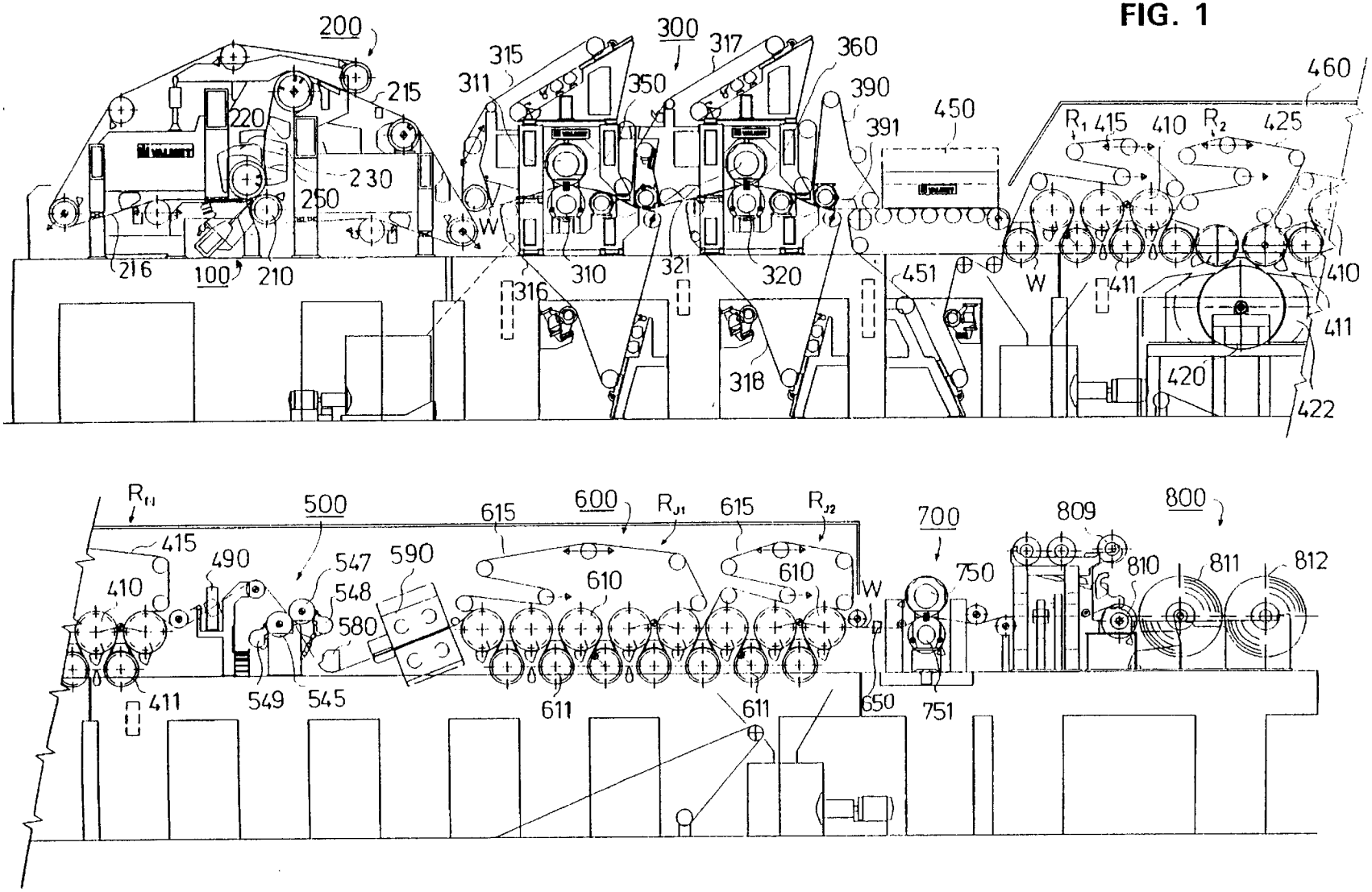
FIG. 1 is a schematic illustration of an exemplifying embodiment of the paper machine in accordance with the present invention for carrying out the method in accordance with the invention.

The advantageous exemplifying embodiment of the paper machine in accordance with the present invention shown in FIG. 1, first, comprises a headbox 100, which is most appropriately a multi-layer headbox in accordance with what is shown in the figure. This is followed by the wire part 200. The headbox 100 and the wire part 200 have such constructions that, in the Z-direction, a structure of paper consisting of layers and/or the desired distribution of additives or fillers in the Z-direction is/are achieved (see the applicant's patent EP 0 651 092). When a retention agent suitable for the purpose and vacuums are employed in the wire part 200, the formation of porosity is promoted. It is, however, also important that good formation is achieved. The former 200 must be such that it does not damage the layer formation that has been produced. The gap former 250 shown in the figure is well suited for this purpose, but formers of other types are also suitable for use, at least to a limited extent. In accordance with the figure, in the press section 300, an extended-nip press is used, for example a shoe press 350,360, and in this way possibilities are created for retaining of the porosity. The press section 300 as shown in the figure comprises two presses 350,360. A forward dryer section 400 is composed of an impingement dryer 450 and of a conventional cylinder dryer 460, which comprises dryer groups $R_{1 \ldots N}$ which make use of single-wire draw. At least one of the dryer groups is composed of a large-diameter cylinder 420 placed in the basement space and of an impingement drying equipment 422 fitted in connection with said cylinder 420. After the forward dryer section 400, there is a film size press 500, which is followed by an after-dryer 600 consisting of dryer groups $R_{J1}$, $R_{J2}$ that apply single-wire draw, as well as a shoe calender 700 and a reel-up 800.

In a paper machine as shown in FIG. 1, the paper web W runs as follows. Out of the multi-layer headbox 100 the stock is fed into the gap formed between the former rolls 210,220 of the gap former 250 in the wire part 200, from which gap the web is passed, between the wires 215 and 216, over water drain devices 230 further, while supported by the wire 215, to the press section 300. The press section 300 comprises two presses 350 and 360, and on the upper fabric 315 of the first press the web W is passed to between the press rolls 311,310 of the press 350 while supported by the lower fabric 316. From the lower fabric 316 the web W is passed onto the upper fabric 317 of the following press 360 and further, between the upper fabric 317 and the lower fabric 318, to between the press rolls 321,320 of the press 360. Each press 350,360 has been formed as a shoe press. From the press section 300 the web W is passed by means of a transfer fabric 390, while a suction box 391 keeps the web W in contact with the fabric, to the impingement drying unit in the dryer section 400, in which unit the web W runs on support of the lower fabric 451 over the impingement drying equipment 450 into the dryer groups $R_1 \ldots R_N$ with single-wire draw in the dryer section 400. Of the cylinder dryer groups, the group $R_2$ has been formed such that it comprises a large-diameter cylinder 420 placed in the basement, in connection with which cylinder impingement drying 422 has been arranged, in which dryer group the web runs on support of the wire 425. The drying wire of the dryer groups with single-wire draw is denoted with the reference numeral 415, and the heated drying cylinders in the upper row with the reference numeral 410, and the reversing cylinders or rolls in the lower row with the reference numeral 411. The web W runs meandering from the reversing cylinders/rolls 411 in the lower row onto the heated drying cylinders 410 in the upper row, on which cylinders the web W is in direct contact with the heated cylinder face. After this the web W is passed through a measurement device 490 to a film size press 500, whose rolls are denoted with the reference numerals 545 and 547, and whose film transfer means are denoted with the reference numerals 548 and 549. Over a contact-free turning device 580 the web W is passed through an infra/airborne-web dryer 590 to an after-dryer section 600, which comprises two dryer groups $R_{J1}$,$R_{J2}$ which make use of single-wire draw and which comprise drying wires 651 and heated drying cylinders 610 as well as reversing cylinders/rolls 611. After the after-dryer section, the web is moistened either with water mist or with steam in view of elimination of possible curl by means of the device 650. After that the web W is passed into a calender 700, which has been formed as a shoe calender, and its rolls are denoted with the reference numerals 750,751. After the calender 700, the web W is passed into a reel-up, in which the paper web W is reeled on the reeling drums 809,810 of the reel-up into paper reels 811,812.

Figure 2:
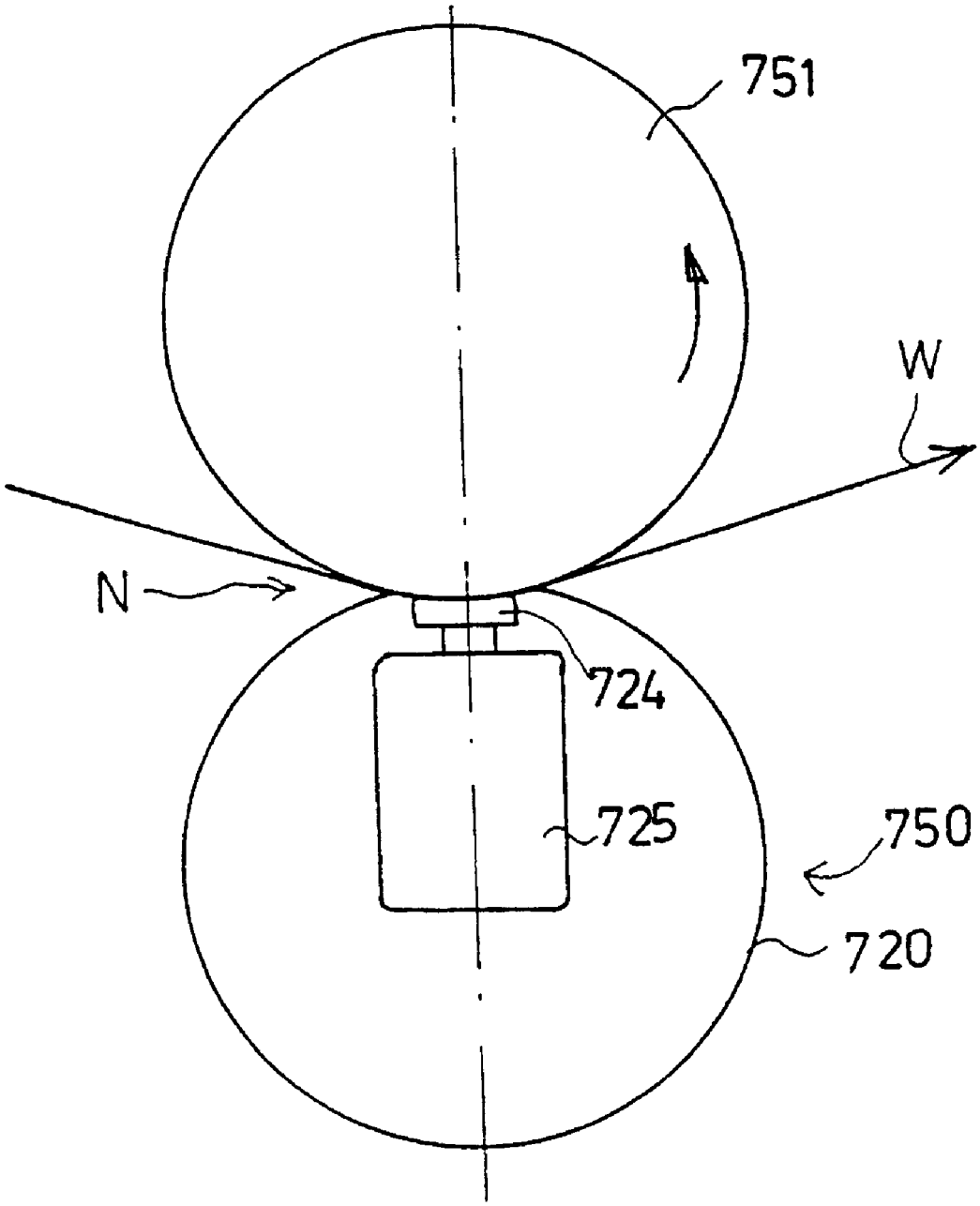
FIG. 2 is a schematic illustration of an embodiment of a calender for a paper machine in accordance with the invention.

FIG. 2 shows a shoe calender, in which an extended calendering nip N is formed between a hot hard roll 750 and a shoe roll 751. The shoe roll 751 again comprises a press shoe 724 supported by a stationary beam 725 as well as a calendering belt 720 passed around the press shoe 724 and the beam 725 and formed as an endless loop. By means of the press shoe 724, the necessary load is produced in the nip N.

Figure 3:
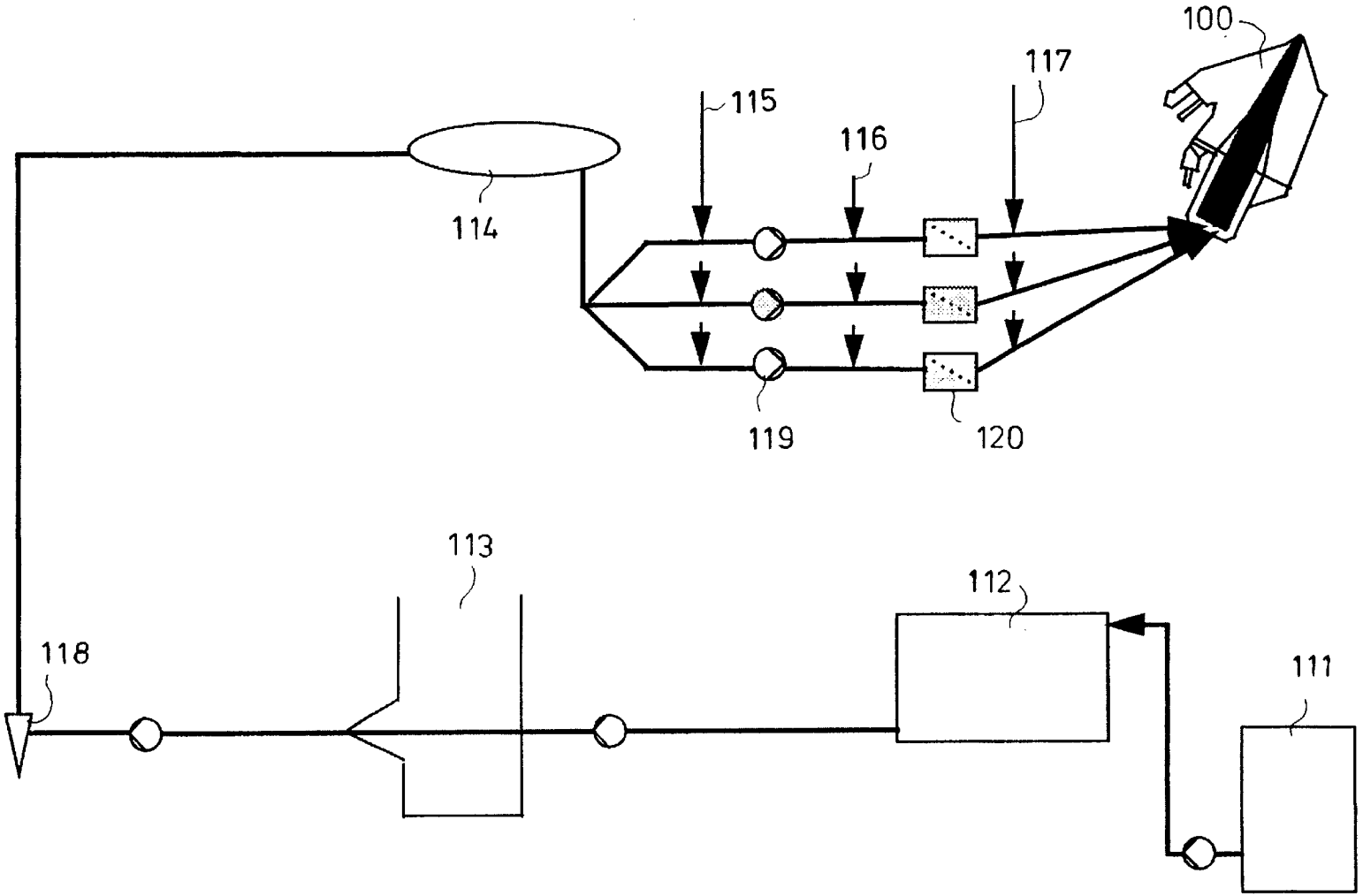
FIG. 3 is a schematic illustration of a preferred solution of the short circulation for a paper machine in accordance with the invention.

FIG. 3 is a schematic illustration of a preferred solution of the short circulation, in which three stocks at different mixing ratios are passed into the inlet headers in the multi-layer headbox 100 in view of formation of layers. From a mixing tank 111 the stock is passed into the machine tank 112, from which it is passed through a wire pit 113 and through removal of impurities 118 to deaeration 114, after which the stock is divided into three ducts, each of which has pumps 119 and 120 of its own. Into the stock, retention agents, fillers and additives can be passed in the desired ratios at three points 115,116,117 before the stock is passed into the headbox 100. In this way the desired layers of compositions are produced in the Z-direction of the web.

Figure 4B:
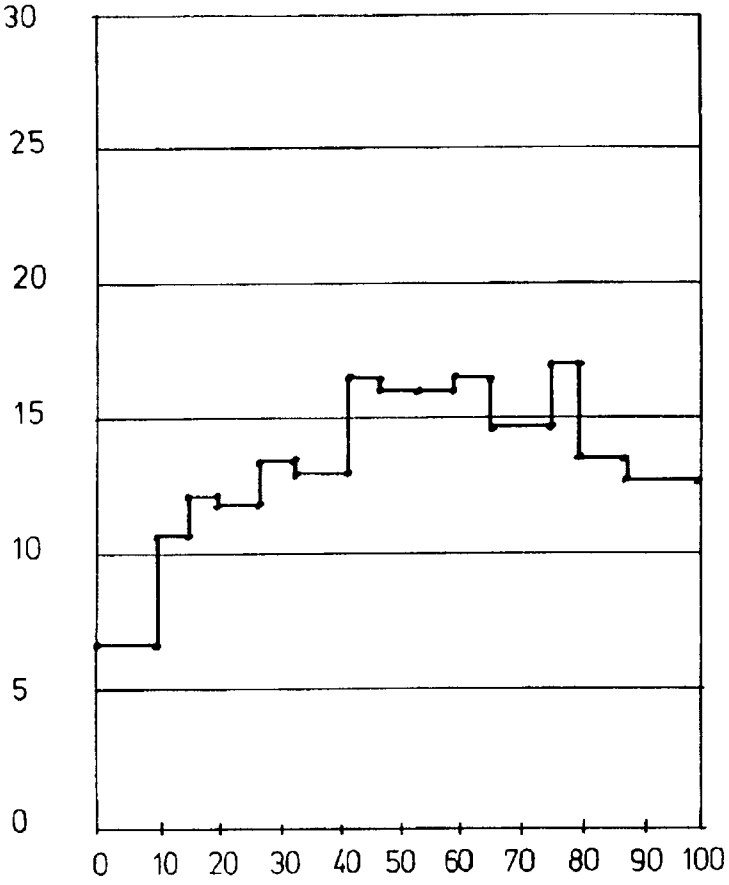
FIGS. 4A–4D are schematic illustrations of a comparison of distribution of fillers.
Figure 4A:
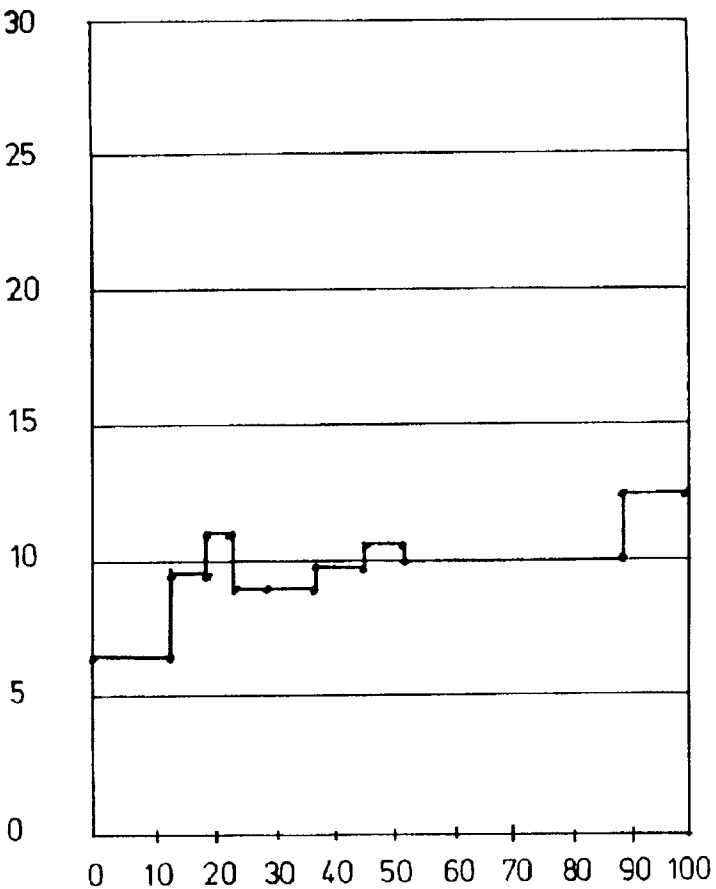
Figure 4D:
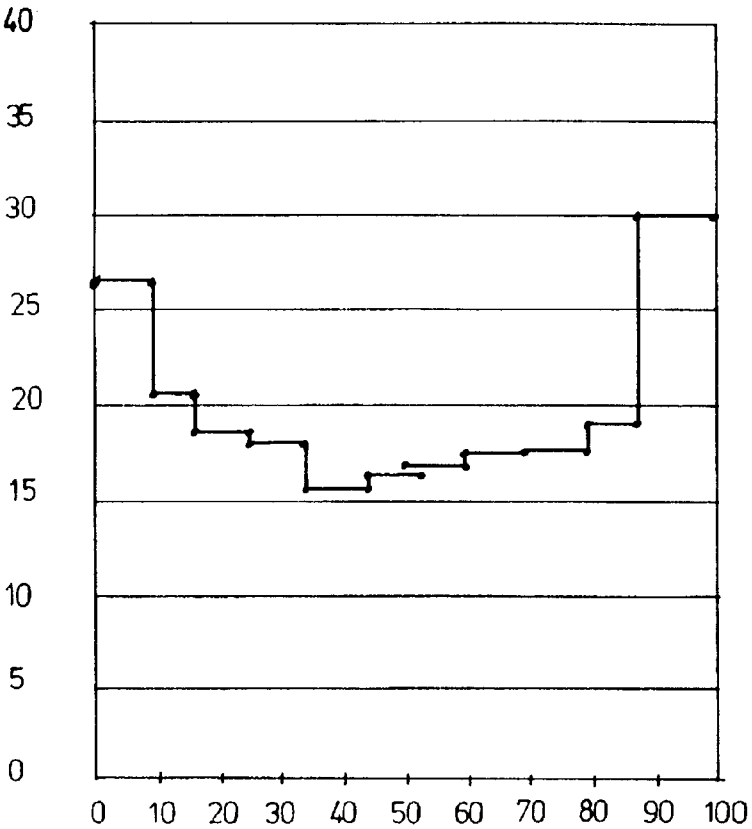
Figure 4C:
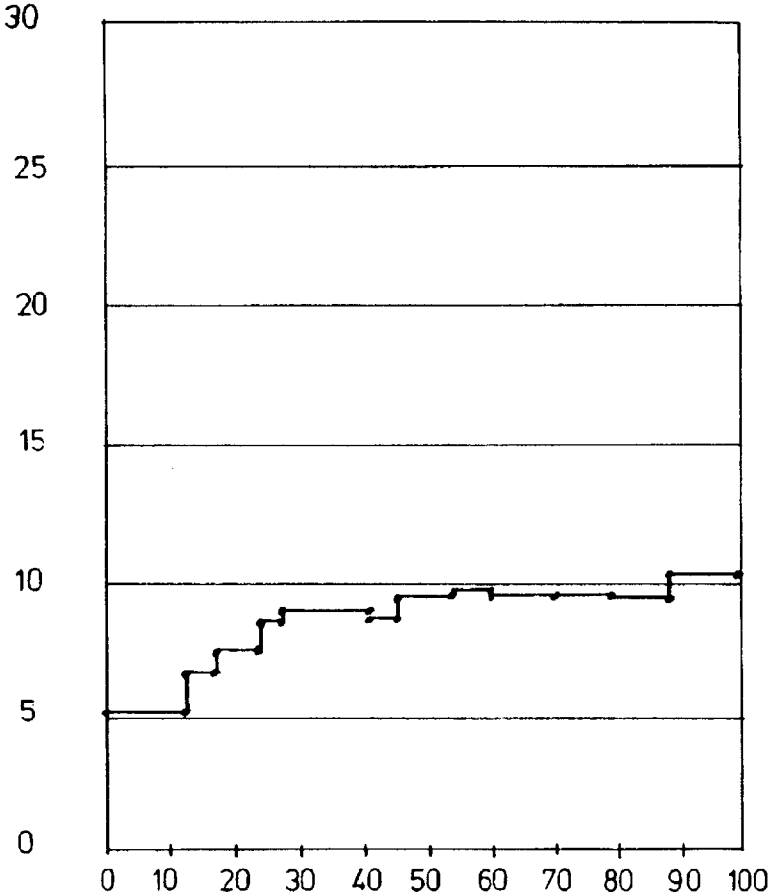

FIGS. 4A–4D illustrate distributions of fillers in different papers. FIGS. 4A–4C illustrate distributions of fillers in colour copying papers, in which in FIG. 4A the filler content is 8.8%, in FIG. 4B 13.2%, and in FIG. 4C 8.7%. FIG. 4D illustrates a distribution of fillers obtained with an arrangement in accordance with the invention in a test run, wherein the filler content was 20%, the weight 97.9 grams per square meter, and the speed of manufacture was 18 meters per second. As comes out from FIG. 4D, the desired distribution of fillers is U-shaped. In FIGS. 4A–4D, the vertical axis represents the filler content as a percentage, and the horizontal axis represents the percentage proportion in the basis weight of the paper.

Figure 5:
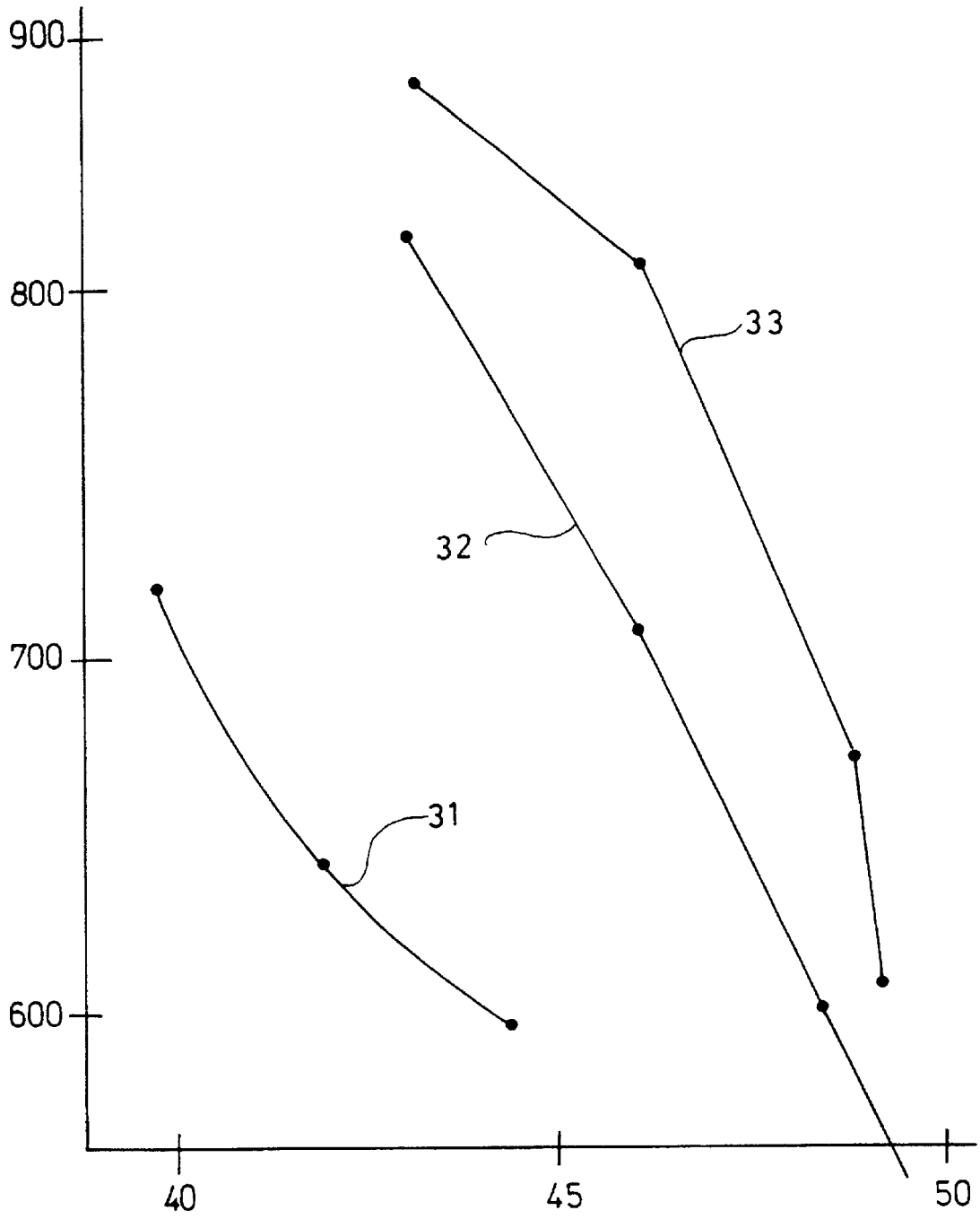
FIG. 5 illustrates the porosity of paper as a function of the dry solids content of the paper when a roll press or a shoe press is employed.

FIG. 5 illustrates the porosity of paper obtained with different presses as a function of the dry solids content. The vertical axis represents the porosity as Bendtsen units, and the horizontal axis represents the dry solids content of the paper. The lower curve 31 has been produced with a roll press, and the upper two curves 32,33 have been produced with a shoe press used in connection with an arrangement in accordance with the invention. As is seen from the figure, a shoe press is advantageous in view of porosity. With the same dry solids content after the press, with a shoe press it is possible to obtain a considerably more porous web than with a roll press; for example, in the case of FIG. 5, when the dry solids content is 45%, the shoe press provides a paper whose porosity is 300 Bendtsen units higher.

Figure 6B:
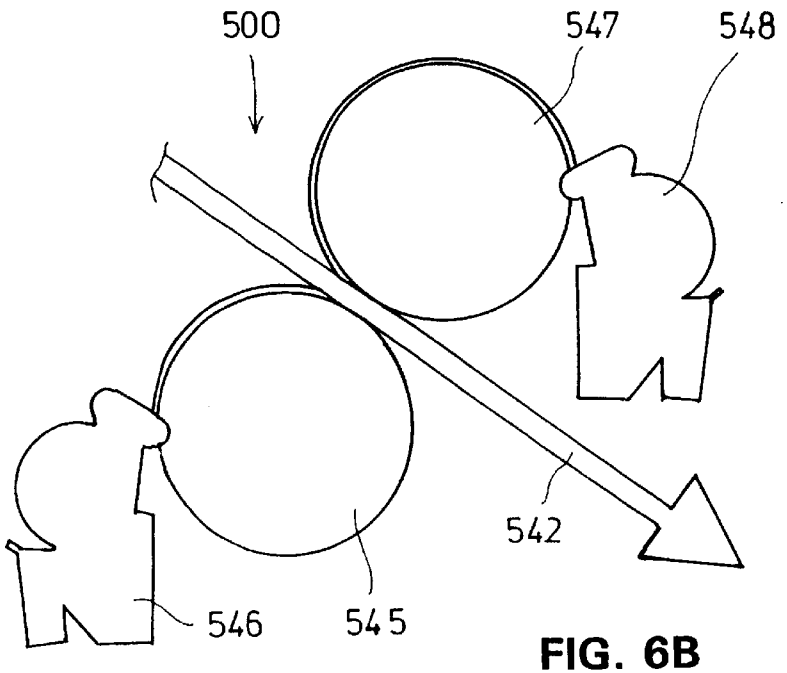
FIGS. 6A–6D are schematic illustrations of the effects of blade coating and film transfer coating in coating of paper.
Figure 6D:
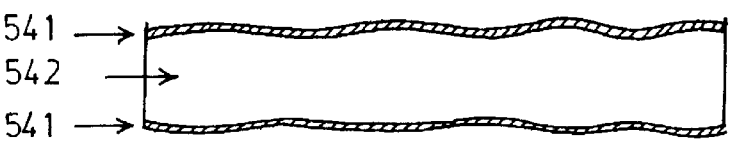
Figure 6C:
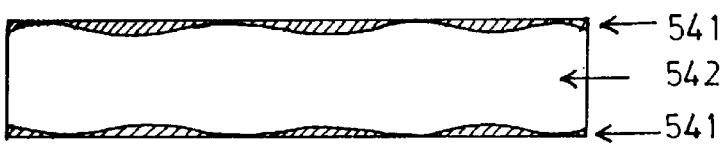
Figure 6A:
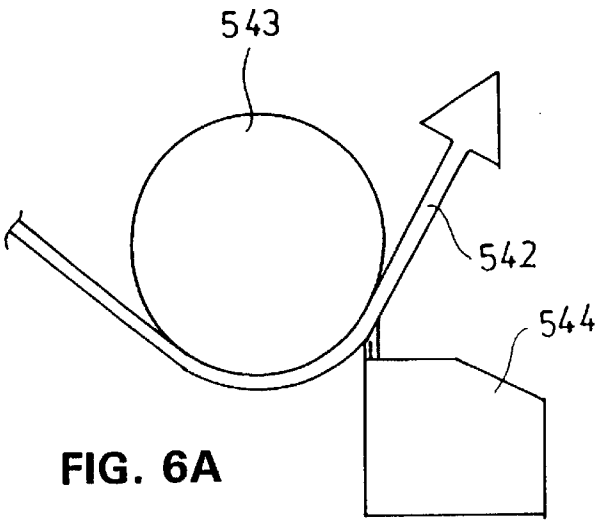

In FIGS. 6A–6D, blade coating, FIG. 6A, has been compared with coating carried out by means of the film transfer method, FIG. 6B, and, as comes out from FIGS. 6C–6D, with the film transfer method more even coating layers 541 are provided on the paper 542. In FIG. 6A, the roll is denoted with the reference numeral 543 and the blade coater with the reference numeral 544, the paper web 542 that passes by being coated by means of said blade coater 544.

FIG. 6B shows a film transfer equipment 500, in which the rolls are denoted with the reference numerals 545 and 547, and by means of said rolls 545,547 coating agent is transferred from the coating device 546,548 onto the face of the paper web 542.

Figure 7:
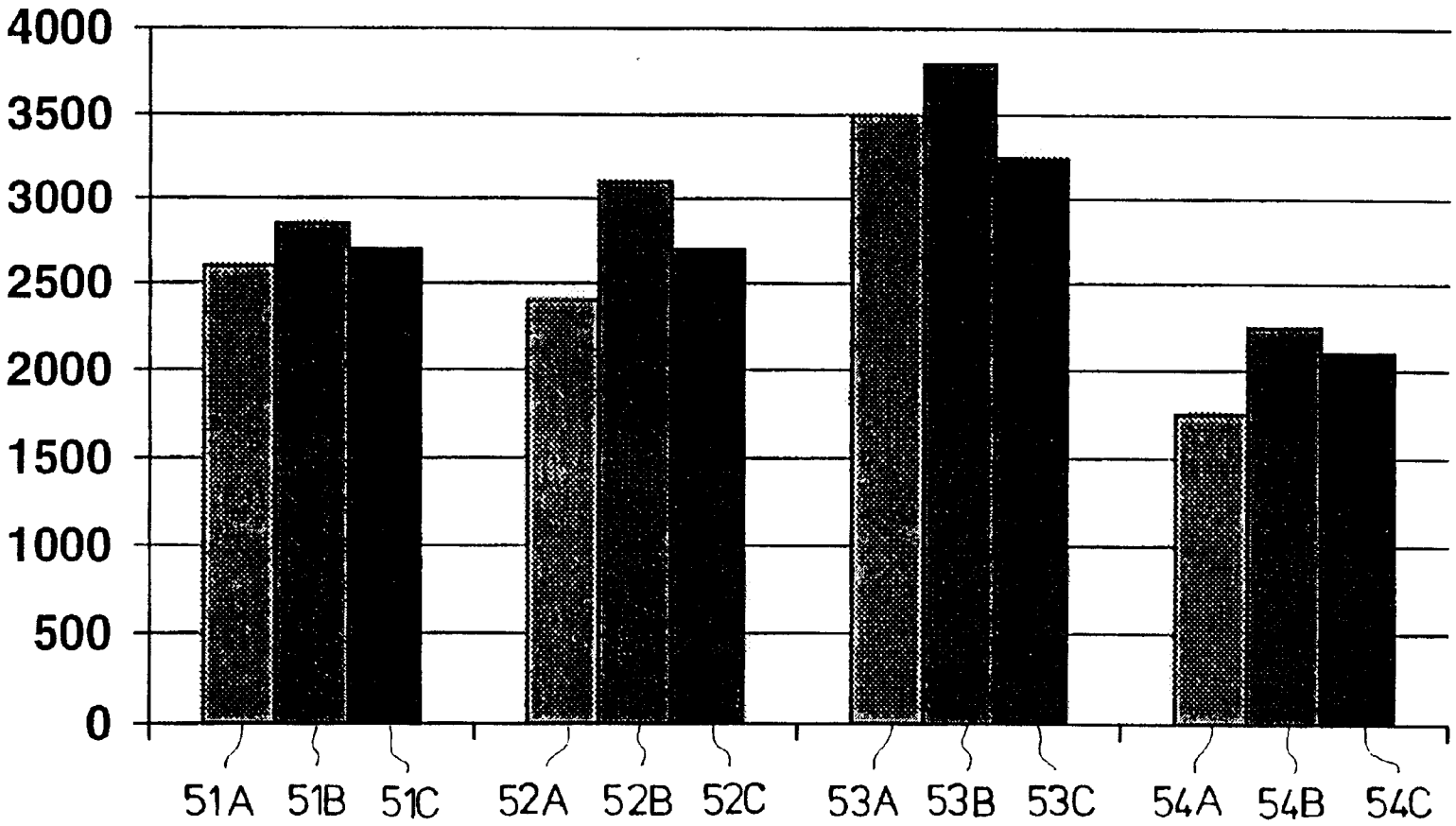
FIG. 7 illustrates the permeability to air of coated paper after different coatings.

In FIG. 7, the vertical axis represents the permeability to air of paper with different coating procedures: columns 51A–51C a short-dwell coater, columns 52A–52C a blade coater, columns 53A–53C a nozzle applicator, and columns 54A–54C a film transfer method. The letter A refers to 0% DIP, B to 40%, and C to 60%. As comes out from the figure, the film transfer method provides the best porosity, which comes from a more uniform layer of coating agent and from less oriented particles. In the test, offset paper of 58 g/m$^2$ was used, the weight of the coating was 8 g/m$^2$. The vertical axis represents the Curley-Hill penetrability to air, and the unit is seconds per 100 milliliters.

Figure 8:
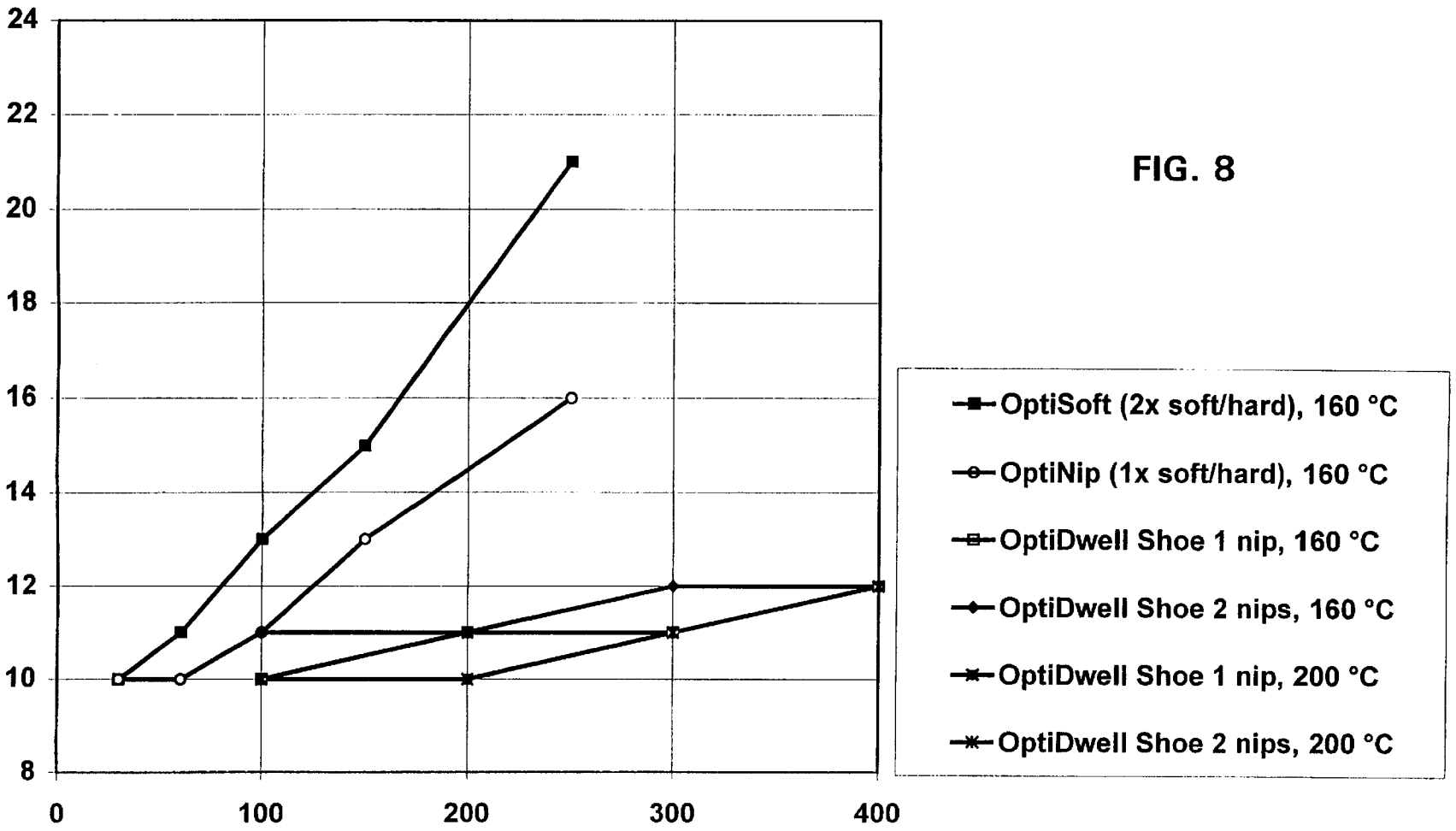
FIG. 8 illustrates the effect of calendering on the density of paper.

FIG. 8 illustrates a comparison of calendering, and the horizontal axis represents the linear load, the unit being kN/m, and the vertical axis represents the resistance to air, the unit being seconds per 100 milliliters. The moisture content of the paper used in the test before calendering was 4.1–4.7%, and the ultimate moisture content was 3.2–4.1%. As comes out from FIG. 8, when shoe calendering was used (curves OptiDwell Shoe 1 . . . 2 nips, temperatures 160/200° C.) there were no losses in porosity.

Above, the invention has been described with reference to some preferred exemplifying embodiments of same only, the invention being, however, by no means supposed to be strictly confined to the details of said embodiments alone.

What is claimed is:

1. A method for manufacturing glossy and porous paper comprising the steps of:

preparing a plurality of stock flows each of said stock flows;

selectively adding to each of said stock flows retention agents, fillers and additives to promote the glossy and porous nature of the paper;

passing each of said stock flows to a headbox;

passing each of said stock flows from said headbox onto a wire of a wire part in layers to produce a web having a plurality of layers arranged in a Z direction to promote the glossy and porous nature of the paper, each one of said layers having a selected distribution of additives and fillers;

feeding said web from said wire part to a press section;

feeding said web from said press section to a dryer section;

feeding said web from said dryer section to a coating section and coating said web in said coating section;

feeding said web from said coating section to an after-dryer section;

feeding said web from said after-dryer section to a calender section; and feeding said web from said calender section to a reel-up; and calendering said web in at least one calendering nip such that a porosity of said web is maintained substantially equal to a porosity of said web prior to said calendering nip wherein said paper has a porosity from about 200 to about 1200 Bendtsen units and wherein said paper has a gloss higher than 20 Hunter 75°.

2. A method according to claim 1, wherein said calendering step comprises calendering said web in a shoe calender.

3. A method according to claim 1, further comprising arranging a gap former in said wire part.

4. A method according to claim 1, further comprising arranging a vacuum in said wire part and wherein said retention agents and said vacuum are employed for promoting a porosity of said web.

5. A method according to claim 1, wherein said calendering step comprises coating said web by means of the film transfer method.

6. A method according to claim 1, further comprising pressing said web in said press section by means of a extended-nip to retain a porosity of said web.

7. A method according to claim 1, wherein said headbox is a multilayer headbox.

8. A method according to claim 1 further comprising drying said paper web in said dryer section by impingement drying.

9. A method according to claim 1, wherein said fillers are added to said stock flows and said stock flows are passed from said headbox to said wire part such that a U-shaped distribution of fillers is formed into said paper web.

10. A paper according to claim 1, wherein said paper has a porosity from about 200 to about 500 Bendtsen units.

11. A paper according to claim 10, wherein said paper has a gloss higher than 25 Hunter 75°.

12. A paper machine for the manufacture of glossy and porous paper, said machine comprising:

a headbox;

a wire part;

a press section;

a dryer section;

a coating section;

an after dryer section;

a calender; and a reel up;

wherein said headbox and said wire part are structured and arranged to form a paper web having a plurality of layers in a Z direction to promote the glossy and porous nature of the paper, said headbox and said wire part being structured and arranged so that each one of said layers has a selected composition;

a short circulation section arranged before said headbox for producing a plurality of stock flows, and wherein said short circulation section includes means for selectively adding fillers and additives to each of said stock flows to promote the glossy and porous nature of the paper; and wherein said calender comprises a calender device structured and arranged to substantially maintain a porosity of said paper web after said calender device at a level substantially equal to a porosity of said paper web prior to said calender device wherein said paper has a porosity from about 200 to about 1200 Bendtsen units and wherein said paper has a gloss higher than 20 Hunter 75°.

13. The paper machine according to claim 12, wherein said calender device includes an extended calendering nip.

14. The paper machine according to claim 13, wherein said calender device is controlled in compliance with loading and provided with a extensible calendering nip.

15. The paper machine according to claim 12, wherein said calendering device is a shoe calender.

16. The paper machine according to claim 12, wherein said coating section includes means for coating said web by the film transfer method.

17. The paper machine according to claim 12, wherein said press section comprises at least one extended-nip press.

18. The paper machine according to claim 12, wherein said wire part includes a former and said former is a gap former.

19. The paper machine according to claim 12, wherein said headbox is a multi-layer headbox.

20. The paper machine according to claim 12, wherein said dryer section includes at least one impingement drying unit.

21. A method for manufacturing glossy and porous paper comprising the steps of:

preparing a plurality of stock flows each of said stock flows;

selectively adding to each of said stock flows retention agents, fillers and additives to promote the glossy and porous nature of the paper;

passing each of said stock flows to a headbox;

passing each of said stock flows from said headbox onto a wire of a wire part in layers to produce a web having a plurality of layers arranged in a Z direction to promote the glossy and porous nature of the paper, each one of said layers having a selected distribution of additives and fillers;

feeding said web from said wire part to a press section;

feeding said web from said press section to a dryer section;

feeding said web from said dryer section to a coating section and coating said web in said coating section;

feeding said web from said coating section to an after-dryer section;

feeding said web from said after-dryer section to a calender section; and feeding said web from said calender section to a reel-up; and calendering said web in at least one calendering nip such that a porosity of said web is maintained substantially equal to a porosity of said web prior to said calendering nip wherein said paper has a gloss higher than 20 Hunter 75°.

22. A paper produced by the method according to claim 21, wherein said paper has a porosity from about 200 to about 1200 Bendtsen units.

* * * * *